US011459152B2

(12) United States Patent
Riepe et al.

(10) Patent No.: US 11,459,152 B2
(45) Date of Patent: Oct. 4, 2022

(54) LOCKOUT BOX

(71) Applicant: ABUS August Bremicker Söhne KG, Wetter-Volmarstein (DE)

(72) Inventors: Bettina Riepe, Wuppertal (DE); Bernhard Garthe, Gevelsberg (DE)

(73) Assignee: ABUS AUGUST BREMICKER SÖHNE KG, Wetter-Volmarstein (DE)

( * ) Notice: Subject to any disclaimer, the term of this patent is extended or adjusted under 35 U.S.C. 154(b) by 258 days.

(21) Appl. No.: 16/917,782

(22) Filed: Jun. 30, 2020

(65) Prior Publication Data

US 2021/0002049 A1 Jan. 7, 2021

(30) Foreign Application Priority Data

Jul. 1, 2019 (DE) ..... 102019117720.0

(51) Int. Cl.
*B65D 55/14* (2006.01)
*B65D 25/28* (2006.01)
(Continued)

(52) U.S. Cl.
CPC ..... *B65D 55/14* (2013.01); *B65D 25/2826* (2013.01); *B65D 43/163* (2013.01);
(Continued)

(58) Field of Classification Search
CPC .. B65D 55/14; B65D 25/2826; B65D 43/163; B65D 2525/281; B65D 43/16;
(Continued)

(56) References Cited

U.S. PATENT DOCUMENTS 4,799,587 A * 1/1989 Desanto ..... A45C 11/32 206/37.8
4,909,579 A * 3/1990 Liu ..... G06F 1/181 220/812
(Continued)

FOREIGN PATENT DOCUMENTS

EP 1807592 B1 1/2012
EP 2944437 A1 11/2015

OTHER PUBLICATIONS

German Search Report from the German Patent and Trademark Office for related German Application No. 102019117720.0 dated Mar. 25, 2020.

*Primary Examiner* — Lloyd A Gall
(74) *Attorney, Agent, or Firm* — Dickinson Wright PLLC

(57) ABSTRACT

The invention relates to a lockout box for locking in objects comprising an upwardly open container; and a cover that is pivotably movably fastened to the container via a joint between a closed position and an open position, wherein the cover is provided with a carry handle for the lockout box at its upper side; wherein a plurality of securing openings are provided in the cover and in the container for the attachment of a plurality of locking elements in order to fix the cover to the container in the closed position; and wherein a closure is provided that enables a carrying of the lockout box at the carry handle in the closed position even when locking elements are not hung in. The cover is linearly displaceably attached to the joint via an adjustment mechanism between a retracted position and an extended position. The closure comprises that, at the side disposed opposite the joint, the cover has a closure part having an engagement section that engages into a closure receiver of the container in the closed position when the cover adopts the retracted position, with the engagement being released when the cover adopts the extended position. The engagement section and the closure
(Continued)

Figure 1:
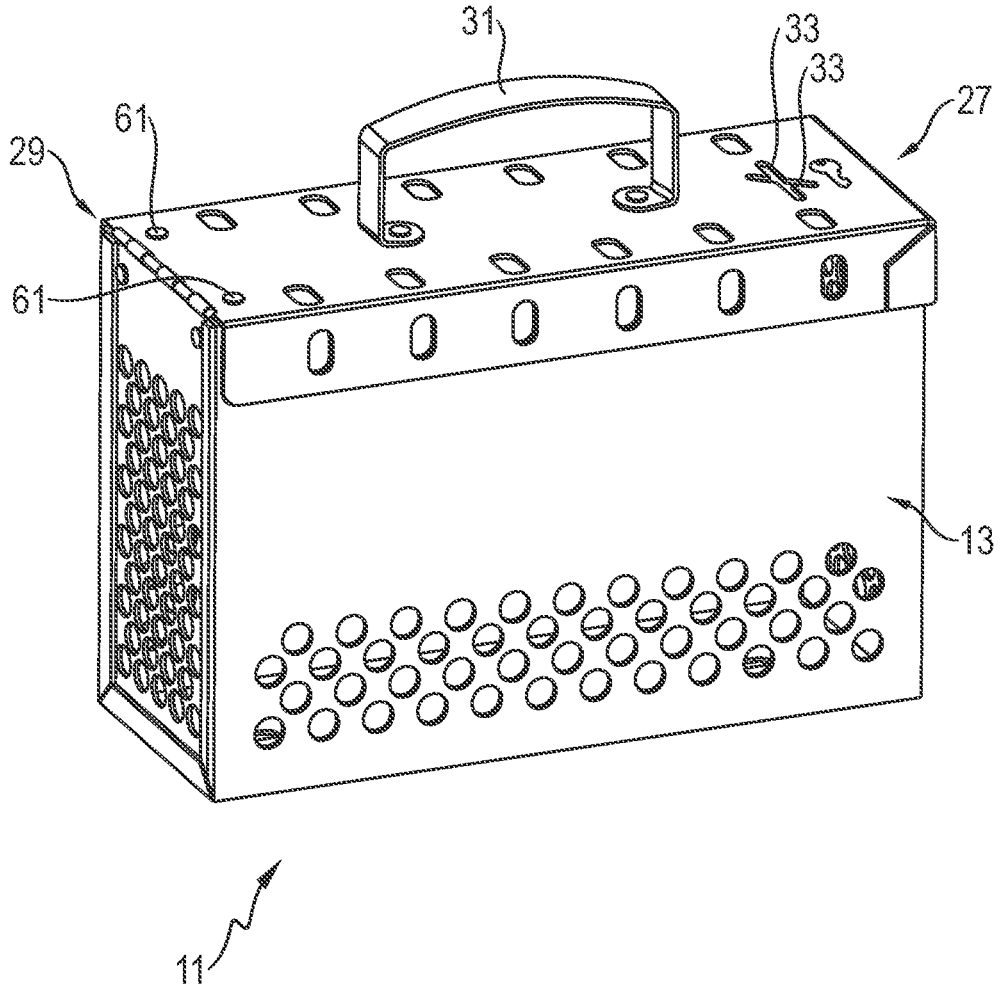

receiver are configured such that, in the closed position, they prevent a displacement of the cover from the retracted position into the extended position by means of a form fit when the cover is raised with respect to the container.

19 Claims, 8 Drawing Sheets

(51) Int. Cl.
*B65D 43/16* (2006.01)
*B65D 55/02* (2006.01)
*E05B 65/52* (2006.01)
*E05B 67/38* (2006.01)

(52) U.S. Cl.
CPC ..... *E05B 65/52* (2013.01); *E05B 67/383* (2013.01); *B65D 2525/281* (2013.01); *E05Y 2900/602* (2013.01)

(58) Field of Classification Search
CPC ..... B65D 25/2802; B65D 55/02; B65D 2543/00009; B65D 2543/00018; E05B 65/52; E05B 67/383; B25H 3/02; Y10T 70/5031; Y10T 70/5544; Y10T 70/5549; Y10T 70/5553; Y10T 70/5558; Y10T 70/5566; Y10T 70/5593; Y10T 70/5597; Y10T 70/5602; Y10T 70/5606
USPC ..... 220/811–813, 324; 109/69–71
See application file for complete search history.

(56) References Cited

U.S. PATENT DOCUMENTS

| | | | | |
|---|---|---|---|---|
| 5,191,974 | A * | 3/1993 | Saalman | E05B 67/383 206/37.1 |
| 7,360,380 | B2 | 4/2008 | Van Handel | |
| 8,322,566 | B2 * | 12/2012 | Hackett | B65D 7/16 220/811 |
| 9,938,061 | B2 * | 4/2018 | Garthe | B65D 85/70 |
| 10,207,847 | B2 * | 2/2019 | Hollis | E05D 15/48 |
| 2005/0199628 | A1 * | 9/2005 | Van Handel | A47G 29/10 220/315 |
| 2010/0147853 | A1 | 6/2010 | Hackett | |
| 2017/0113856 | A1 * | 4/2017 | Hollis | B65D 43/20 |
| 2018/0371824 | A1 * | 12/2018 | Ensign | E05G 1/026 |
| 2019/0382174 | A1 * | 12/2019 | Enger | B65D 43/167 |

* cited by examiner

LOCKOUT BOX

CROSS-REFERENCES TO RELATED APPLICATIONS

This patent application claims priority to German Patent Application Serial No. 102019117720.0, filed Jul. 1, 2019, which is incorporated herein by reference in its entirety.

The invention relates to a lockout box for locking in objects, in particular keys, comprising an upwardly open container, in particular a parallelepiped container, for the objects; and a cover that is pivotably movably fastened to the container at one side via a joint between a closed position and an open position about a pivot axis defined by the joint, wherein the cover is provided with a carry handle for the lockout box at its upper side; wherein a plurality of securing openings are provided in the cover and in the container for the attachment of a plurality of locking elements, in particular padlocks, in order to fix the cover to the container in the closed position; and wherein a closure is provided that enables a carrying of the lockout box at the carry handle in the closed position of the cover even when locking elements are not hung in.

A lockout box of the initially named kind is mainly used for a so-called group lockout in connection with a maintenance, a repair or a cleaning of a machine or of a plant when a plurality of employees participating in the maintenance, the repair or the cleaning have to lock out one or more sources of energy at the machine or at the plant. In order to keep the time effort for the lockout and the number of necessary safety locks as low as possible, the individual sources of energy are each only locked with one safety lock in a group lockout. The keys of these locks are then locked in into the lockout box. Each employee hangs his personalized lock at the outside into securing openings provided for this purpose and locks it such that the lockout box can no longer be opened. Each employee thus does not have to hang his respective lock at each locked out source of energy, but rather only once at the lockout box without the intention of a "lock out" and/or the safety achieved thereby being impaired. The sources of energy can only be actuated again when all the employees have removed their locks from the lockout box after completing their work since the lockout box can only then be opened again and the keys stored therein can be removed for unlocking the locks at the sources of energy.

A lockout box of the initially named kind is known from the document EP 2 944 437 A1. To be able to carry the lockout box in the closed position of the cover even when padlocks are not hung in, a closure is additionally provided that has a first closure part which is attached to the inner side of the cover and which, in the closed position of the cover, forms a snap-in connection for closing the cover at the container with a resilient second closure part that is attached to the inner side of a side wall of the container. The two closure parts are in this respect configured in the form of two snap hooks cooperating with one another. A push button is arranged at the outer side of the side wall of the container and is supported at the second closure part via a bolt or the like. If the push button is pressed, the second closure part is pressed inwardly away from the side wall, whereby the snap-in connection with the first closure part is released such that the cover can be opened and/or opens on its own on the basis of a preload effected by springs. Such a closure indeed already has a comparatively simple design; however, it nevertheless requires a plurality of components attached and cooperating in the manner described.

A lockout box having a container and a cover is known from the document U.S. Pat. No. 7,360,380 B2 in which a closure is provided that is displaceably held at the inner side of the cover. If the closure is adjusted into its locking position in the closed position of the cover, the cover cannot be opened anymore. The lockout box can then be carried at a carry handle provided at the closure. However, such a closure is complex and/or expensive in production.

It is the underlying object of the present invention to provide a lockout box of the initially named kind that provides a simple and inexpensive possibility of enabling a carrying of the lockout box at the carry handle in the closed position of the cover even when padlocks are not hung in.

This object is satisfied by a lockout box having the features of claim 1 and in particular in that the cover is linearly displaceably attached to the joint via an adjustment mechanism between a retracted position and an extended position in a direction perpendicular to the pivot axis; in that the closure comprises that, at the side disposed opposite the joint, the cover has a closure part having an engagement section that engages into a closure receiver of the container in the closed position of the cover when the cover adopts the retracted position, with the engagement being released when the cover adopts the extended position, whereby a pivoting of the cover into the open position is selectively blocked or made possible; and in that the engagement section and the closure receiver are configured such that, in the closed position, they allow a displacement of the cover from the retracted position into the extended position when the cover lies on the container and prevent a displacement of the cover from the retracted position into the extended position by means of a form fit when the cover is raised with respect to the container.

It was therefore recognized in accordance with the invention that a secured closure, such as is known from the initially named prior art and in which an actuation of a push button is indispensable to release the closure, is not necessary to enable a carrying of the lockout box at the carry handle in the closed position of the cover even when padlocks are not hung in, but that it is rather sufficient if the closure is secured against a release in the state in which the lockout box is carried at the carry handle. A securing against such a release is, in contrast, not necessary at all in the state in which the cover lies on the container, in particular due to gravity.

This is achieved by arranging the cover in a linearly displaceable manner, with the cover and the container being in engagement with one another in the retracted position and being out of engagement in the extended position. When the cover lies on the container, the cover can easily be displaced from the retracted position into the extended position. The closure between the retracted cover and the container is therefore not secured in this state. If the lockout box is, in contrast, carried at the carry handle when the cover is retracted, with the cover in particular being slightly raised with respect to the container in so doing, a form fit between the engagement section of the closure part of the cover and the closure receiver of the container is produced in the direction of displacement of the cover, which form fit prevents the cover from reaching the extended position. In accordance with the invention, the closure is therefore only secured against a release in the state of the lockout box carried at the carry handle.

The closure of the lockout box in accordance with the invention is, in particular due to the small number of components and the low complexity of the underlying mechanism, less complex than the closure known from the prior art and can therefore be manufactured in a particularly inexpensive manner. The required displaceability of the cover can in this respect be achieved without a great additional effort. Furthermore, the lockout box in accordance with the invention is particularly easy and intuitive to operate.

It is preferred for the joint to comprise at least one hinge, in particular a rolled hinge, in particular an inner hinge, having two wings, with the container, in particular a side wall of the container, being fastened to the one wing and the cover being fastened to the other wing of the hinge, in particular of the respective hinge. Hinges can be manufactured in a particularly simple and inexpensive manner.

It is preferred in this respect for the adjustment mechanism to comprise an elongate hole arrangement, with the cover being linearly displaceably fastened to the other wing of the hinge, in particular of the respective hinge, via the elongate hole arrangement. Due to an elongate hole arrangement, the displaceability of the cover with respect to the container can be achieved in a particularly simple manner.

In this respect, it is in turn preferred for the elongate hole arrangement to comprise one or more elongate holes that are formed in the other wing of the hinge, in particular of the respective hinge, and/or that extend in parallel with one another. It can be achieved by the hinge-side formation of the elongate holes that the elongate holes are covered by the cover so that the adjustment mechanism is arranged in a protected manner and is thus less susceptible. The linear displaceability of the cover can be ensured in a simple manner by a plurality of elongate holes extending in parallel with one another.

The closure part is preferably attached to an inner side of the cover, in particular of a collar of the cover that engages over the container in the closed position. The engagement of the engagement section into the closure receiver of the container can hereby be implemented in a particularly simple manner.

In accordance with a preferred embodiment, the closure part is configured as a planar sheet metal part, in particular as a planar sheet metal strip, having an angled end section that is in particular horizontally oriented in the closed position of the cover and/or that faces toward the retracted position in the direction of displacement and that forms the engagement section. A sheet metal part can be manufactured in a particularly simple and inexpensive manner and can be simply attached to the cover.

Furthermore, the closure receiver can be configured as an engagement opening formed in a side of the container, in particular as an engagement slot that is in particular horizontal, through which engagement opening the engagement section of the closure part can be led when the cover is displaced from the extended position into the retracted position. Such an engagement opening can be manufactured in a particularly simple and thus particularly inexpensive manner. An engagement opening configured as an engagement slot can in particular be provided in a closure part configured as a sheet metal part, as explained above.

The form fit between the engagement section and the closure receiver can in particular be achieved in that the engagement section, in particular at its upper side, comprises an elevated portion, i.e. an upwardly directed projection, that, in the retracted position of the cover, engages behind the side wall of the container at an inner side when the cover is raised with respect to the container.

The elevated portion is preferably produced by a sheet metal shaping process of the engagement section manufactured from sheet metal, in particular by means of a punch. The elevated portion is then in particular formed as an impression at the oppositely disposed side, in particular at the lower side, of the engagement section. Such an elevated portion can be produced in a particularly simple and inexpensive manner. In this respect, provision can in particular be made that the elevated portion only extends over a part of the width of the engagement section and is in particular only centrally provided in the width direction of the engagement section. When the cover is displaced between the retracted position and the extended position, the engagement section can then lie on the lower edge of the engagement opening, configured as a horizontal engagement slot, with the non-deformed region of the engagement section and can therefore be retracted or extended without getting caught.

Provision is in particular made that the engagement section faces toward the retracted position in the direction of displacement and/or that the engagement section has a height that is less than the height of the engagement opening or equal to the height of the engagement opening.

Provision can furthermore be made that, in the closed position of the cover, the securing openings provided in the cover and in the container only mutually overlap in the retracted position of the cover. In the extended position, the securing openings of the container are then at least covered by the cover material to the extent that a leading through of the hoops of padlocks is not possible. It is hereby indicated to a user of the lockout box that the cover is not in the retracted position, i.e. the closure is released and the cover can pivot into the open position without impediment so that the lockout box should not be raised at the carry handle in this state.

The cover is preferably pivotably movably fastened to one of two lateral side walls of the container, with the lateral side walls having a smaller width than rear and front side walls of the container. The rear and front side walls can in particular each have a width that is at least twice as large, in particular at least two and a half times as large, as the lateral side walls. A cover that is displaced along its larger extent can be particularly easily guided at the container in this respect.

The securing openings can only be provided at the rear side wall and at the front side wall of the container and at the corresponding sides of the cover. The lockout box then does not have any securing openings at the two sides at which the joint and the closure are arranged. The closure can thus be designed independently of any restrictions due to securing openings or padlocks hung therein. Securing openings are anyway not required at the joint side.

Figure 2:
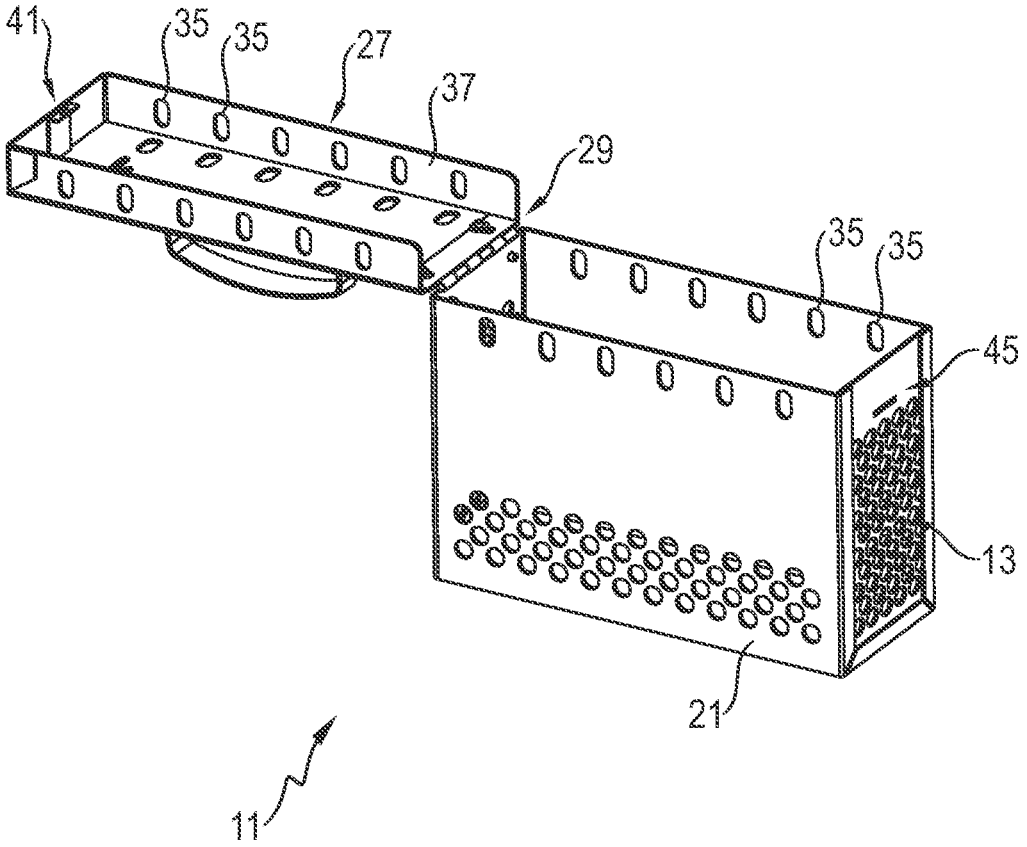
Figure 3:
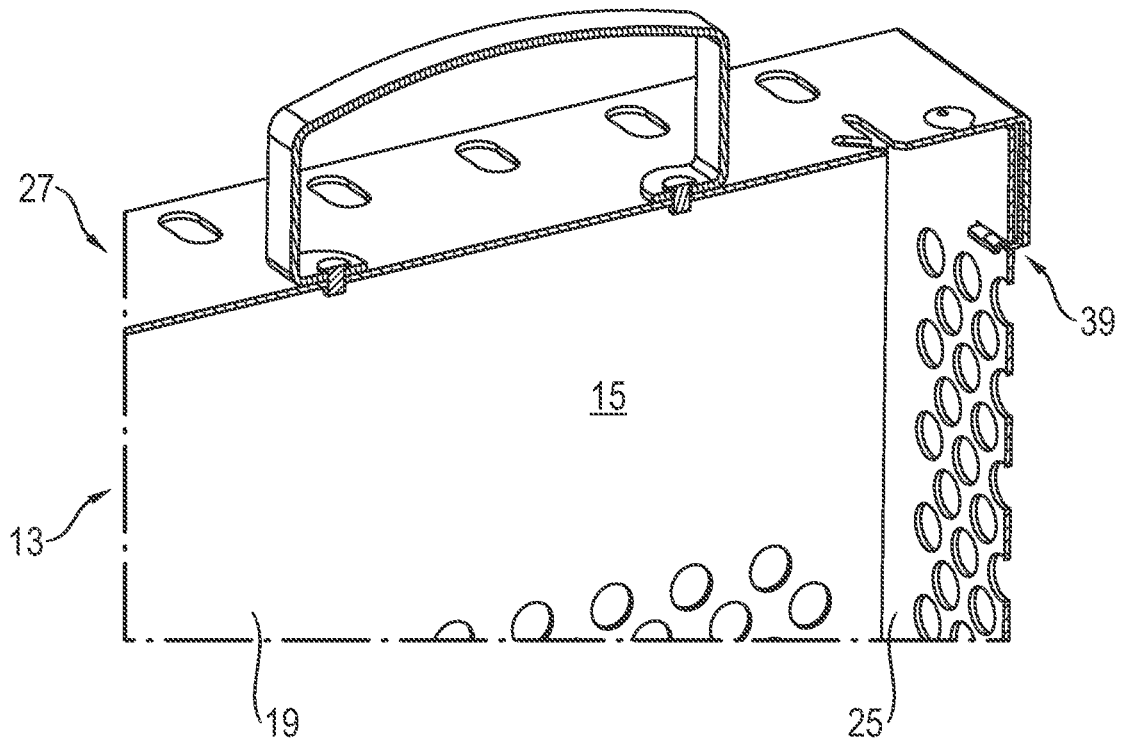
Figure 4:
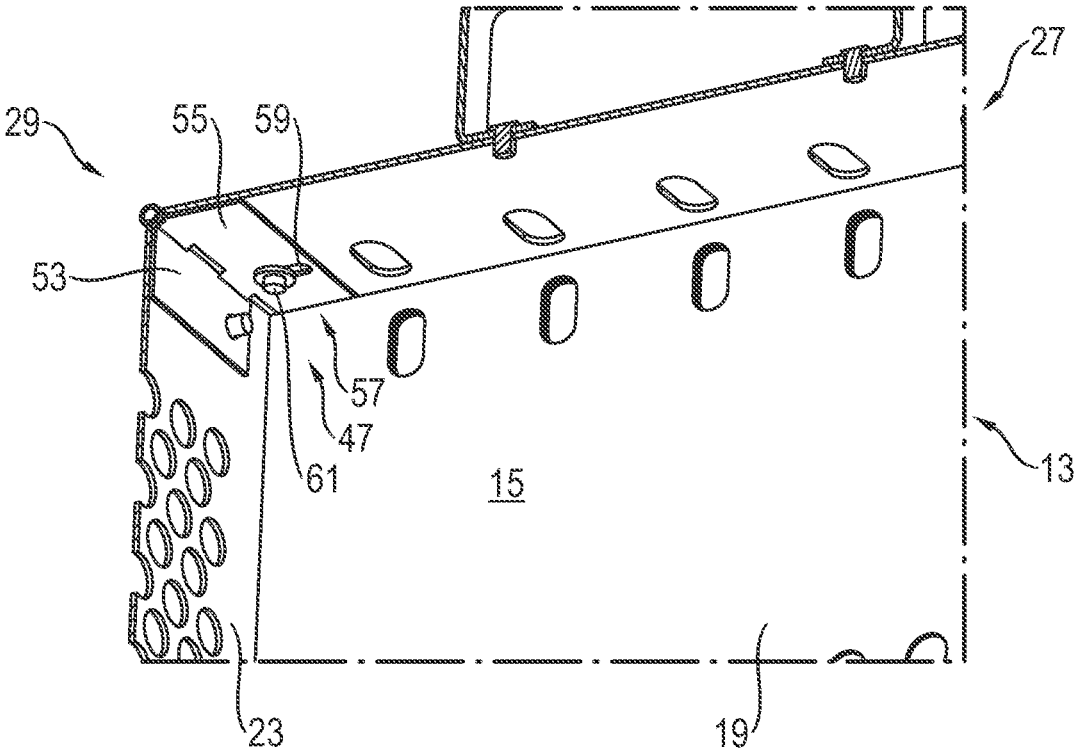
Figure 5:
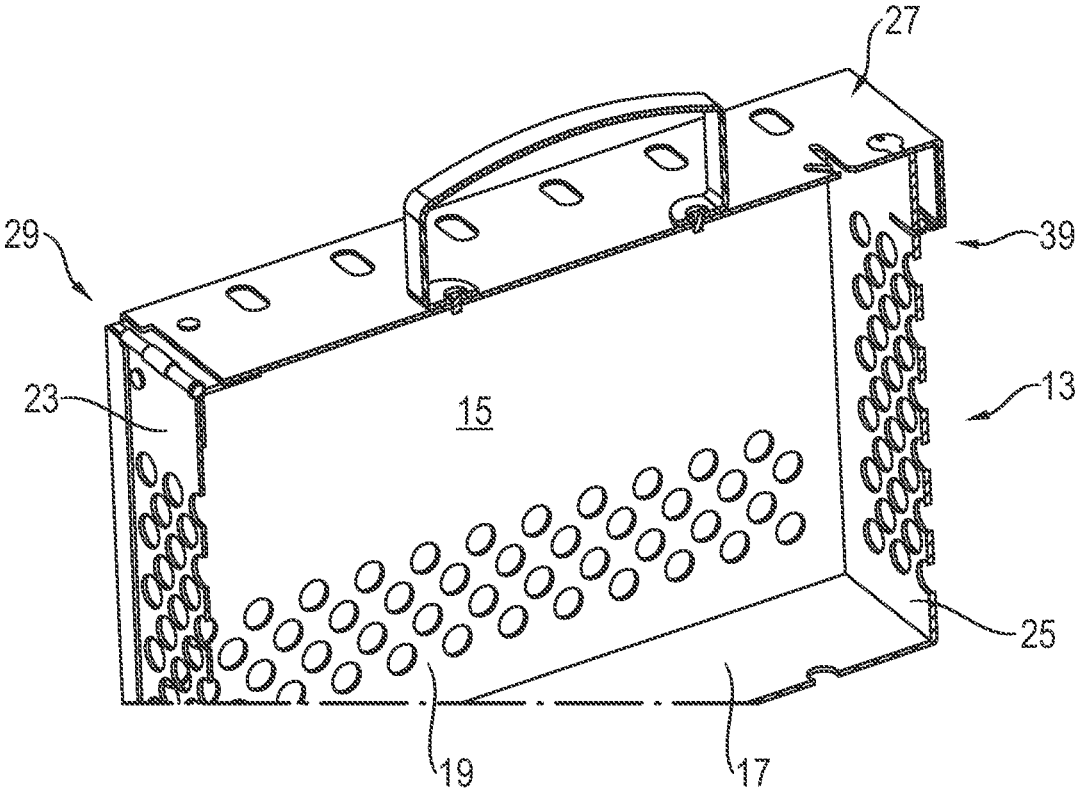
Figure 6:
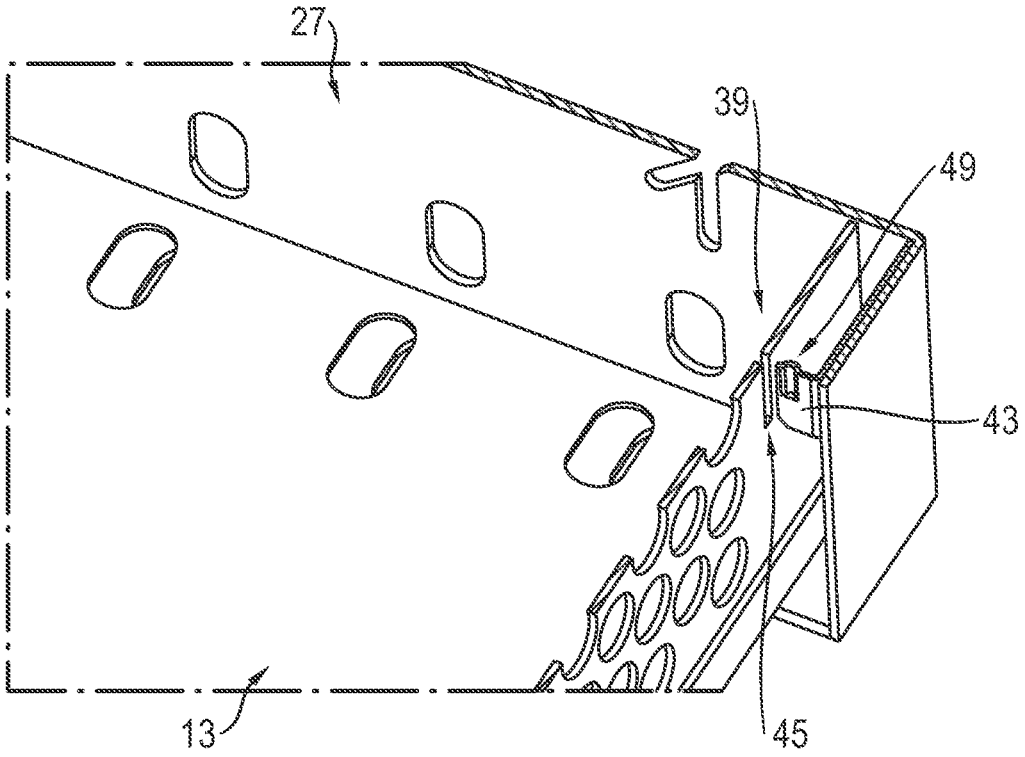
Figure 7:
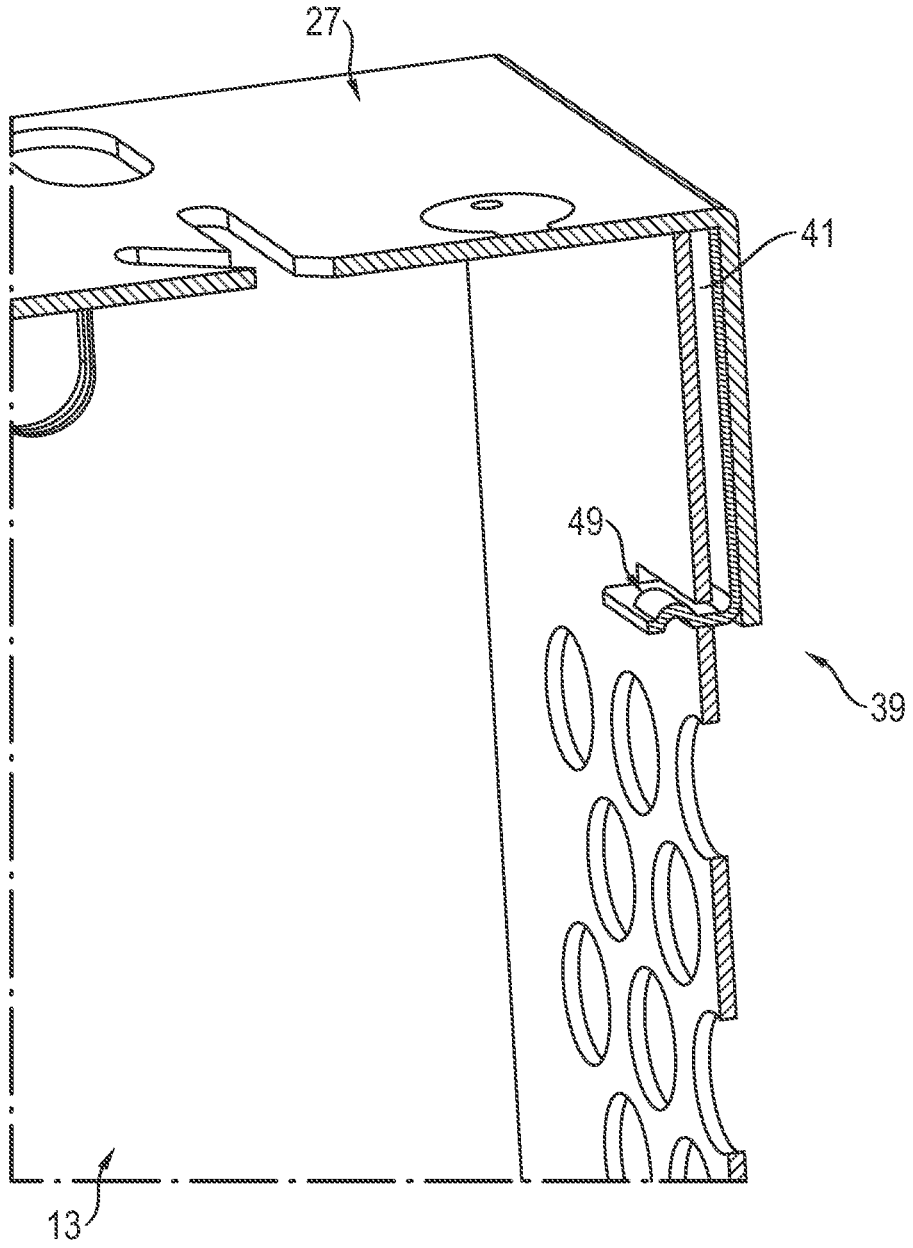
Figure 8:
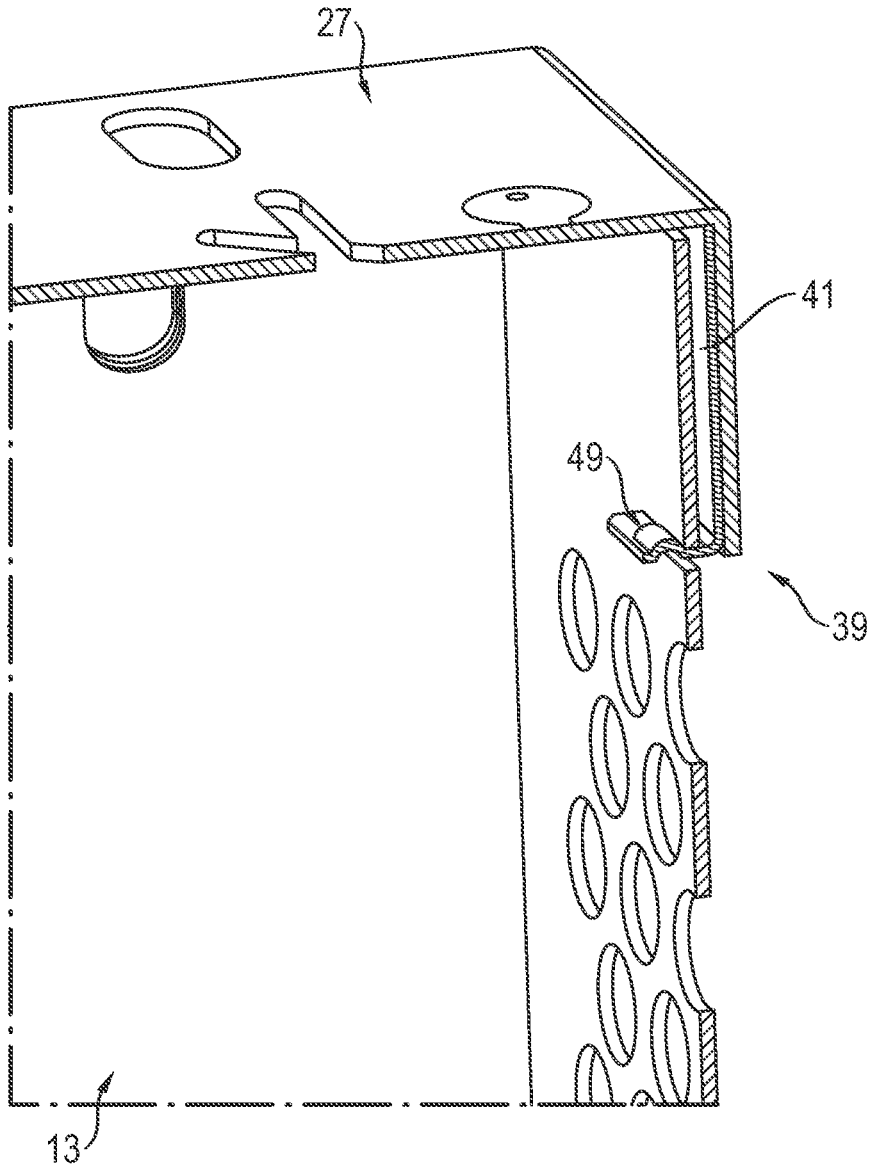

The invention will be described by way of example in the following with reference to an advantageous embodiment and to the drawings. There are shown:

FIG. 1 a perspective view of an embodiment of a lockout box in accordance with the invention with a closed cover;

FIG. 2 a perspective view of the lockout box of FIG. 1 with an open cover;

FIG. 3 a central longitudinal section through the lockout box of FIG. 1 in the region of a closure for the cover;

FIG. 4 the longitudinal section in accordance with FIG. 3 in a different view and in the region of an adjustment mechanism for the cover;

FIG. 5 the cover in accordance with FIG. 3 in an extended position;

FIG. 6 the closure in accordance with FIG. 3 with an extended cover;

FIG. 7 the closure in accordance with FIG. 3 with a retracted cover when the cover lies on the container; and FIG. 8 the closure in accordance with FIG. 3 with a retracted cover when the cover is raised with respect to the container.

The lockout box 11 shown in FIGS. 1 to 8 comprises a parallelepiped container 13 having an upwardly open reception space 15. The container 13 is in this respect formed by a container base 17, a rear side wall 19, a front side wall 21, a left side wall 23, and a right side wall 25. The container base 17 and the side walls 19, 21, 23 and 25 define respectively surround the reception space 15. In the lockout box 11 shown, a cover 27 is pivotably fastened to the left side wall 23 of the container 13 via a joint, namely a hinge 29, in particular an inner hinge.

As FIGS. 1 and 2 show, the cover 27 is adjustable from a closed position (cf. FIG. 1) in which the reception space 15 is closed into an open position (cf. FIG. 2) in which the reception space 15 is open. Furthermore, a carry handle 31 is arranged at the outer side of the cover 27 and is fixedly attached to the outer side of the cover 27 to be able to comfortably transport the lockout box 11.

The lockout box 11 is a group lockout box. The lockout box 11 is used in a so-called group lockout in which a plurality of employees participating in a maintenance, a repair or a cleaning of a machine or of a plant or of another device have to secure and/or lock out one source of energy or a plurality of sources of energy. To keep the time effort for the lockout of such sources of energy and the number of necessary locks for the lockout of the sources of energy as small as possible, the individual sources of energy in the group lockout are each only locked with one safety lock. The keys of these locks are then locked in into the lockout box 11. The lockout box 11 in particular has two intersecting drop slots 33 at the cover 27 to throw keys into a lockout box 11 that is already closed or is still closed.

The lockout box 11 has a plurality of securing openings 35 in the cover 27 and in the container 13 into which padlocks can be hung. In a group lockout, each of the participating employees hangs his personalized padlock into a set of three mutually corresponding securing openings 35 when the cover 27 is closed and thus locks the cover 27 at the container 13 in the closed position. Each employee thus does not have to hang his lock at each locked out source of energy, but rather only once at the lockout box 11 without the intention of the lockout and the security achieved by the lockout being impaired.

The sources of energy can only be actuated again when all the employees have removed their padlocks from the lockout box 11 again after completing their work and have thus released the cover 27 again. The cover 27 can then be brought into the open position again in order to remove the locked in keys of the safety locks attached to the sources of energy.

As can in particular be seen from FIGS. 1 and 2, the rear side wall 19 or the front side wall 21 is the longer side in comparison with the left side wall 23 or the right side wall 25. The rear or the front side wall 19, 21 thus has a larger width than the lateral side walls 23, 25. The cover 27 is therefore hinged at a short side of the container 13. When the cover 27 is opened, its long sides thus pivot upwardly.

When a padlock is hung into a set of securing openings 35, a slight clearance between the hoop of the padlock and the three securing openings 35 is normally present. To avoid an air gap, through which a key could fall to the outside, from arising between the cover 27 and the side walls 19, 21, 25 due to the clearance, the cover 27 has a collar 37 that is pulled downwardly at the right edge and at the front and rear edges of the cover 27 and that covers an upper region of the side walls 19, 21 and 25 when the cover 27 is closed.

In the lockout box 11, no securing openings 35 for hanging in padlocks are provided at the left side wall 23 that has the hinge 29, at the right side wall 25, and at the corresponding adjacent cover sections. In contrast, securing openings 35 are formed in the rear side wall 19, at the front side wall 21, and at the corresponding adjacent cover sections to be able to attach a total of twelve padlocks to the lockout box 11.

To enable a carrying of the lockout box 11 at the carry handle 31 in the closed position of the cover 27 even when padlocks are not hung in, a closure 39 (cf. FIG. 3) is provided at the side of the lockout box 11 disposed opposite the hinge 29. The closure 39 comprises a closure part 41 having an engagement section 43 which, in the closed position of the cover 27, can selectively engage into an engagement opening in the form of a horizontal engagement slot 45 that is formed in the right side wall 25 of the container 13 and that forms a closure receiver. To enable the selective engagement, the cover 27 is linearly displaceably attached to the hinge 29 by means of an adjustment mechanism 47 (cf. FIG. 4) in a direction perpendicular to its pivot axis of the cover 27, i.e. the cover 27 can be adjusted between a retracted position, as is shown in FIG. 1, and an extended position, as is shown in FIG. 5.

The closure part 41 is attached to the inner side of the collar 37 of the cover 27 (cf. in this respect also FIG. 2) and is configured as a planar sheet metal strip having an angled end section, wherein the end section forms the engagement section 43 that is horizontally oriented in the closed position of the cover 27 and that engages into the engagement slot 45 when the cover 27 is closed and in the retracted position of the cover 27 so that a pivoting of the cover 27 into the open position is blocked. If, in contrast, the closed cover 27 adopts the extended position, the engagement between the engagement section 43 and the engagement slot 45 is released so that the cover 27 is released for a pivoting into the open position.

To secure the cover 27 in the retracted position when the lockout box 39 is carried at the carry handle 31 when padlocks are not hung in, the engagement section 43 and the engagement slot 45 are configured such that, in the closed position, a displacement of the cover 27 from the retracted position into the extended position is prevented by means of a form fit between the engagement section 43 and the engagement slot 45, said form fit only being produced when the cover 27 is raised with respect to the container 13.

For this purpose, the engagement section 43 has an upwardly directed elevated portion 49 (cf. FIG. 6) that is produced by shaping, in particular by pressing in, the engagement section 43 produced from sheet metal from below using a punch. The elevated portion 49 is therefore accompanied by a corresponding pressing in at the lower side of the engagement section 43. In the retracted position of the cover 27, the elevated portion 49 engages behind the right side wall 25 of the container 13 at an inner side when the cover 27 is raised with respect to the container 13 so that a displacement of the cover 27 from the retracted position into the extended position is prevented in a form-fitted manner (cf. FIG. 8). If the cover 27 is, in contrast, not raised with respect to the container 13, but only lies on the container 13, this form fit is not present (cf. FIG. 7).

The elevated portion 49 is in particular only centrally provided in the horizontal width direction of the engagement section 43, i.e. a respective region of the engagement section 43 that is not deformed with respect to the strip-shaped design of the closure part 41 is present at both sides of the elevated portion 49. When the cover 27 is displaced between the retracted position and the extended position, the engagement section 43 can then lie on the lower edge of the engagement slot 45 with the non-deformed regions of the engagement section 43 and can be displaced there without getting caught.

As can in particular be seen from FIG. 4, the hinge 29 has two wings 53, 55, with the one wing 53 of the hinge 29 being fastened to the left side wall 23 of the container 13 and the other wing 55 of the hinge 29 being fastened to the collar 37 of the cover 27. To equip the cover 27 with the above-explained displaceability, the adjustment mechanism 47 comprises that the cover 27 is linearly displaceably fastened to the other wing 55 of the hinge 29 via an elongate hole arrangement 57. The elongate hole arrangement 57 has two elongate holes 59 (of which only one elongate hole 59 is shown in FIG. 4 due to the selected longitudinal section) that extend in parallel with one another and that are formed in the other wing 55 of the hinge 29. The cover 27 is in this respect fastened to the hinge 29 via two pins 61 (of which likewise only one pin 61 is shown in FIG. 4 due to the selected longitudinal section) that are each fastened in a stationary manner to the cover 27, on the one hand, and that are longitudinally displaceably guided in one of the two elongate holes 59, on the other hand.

When the cover 27 is closed, the securing openings 35 provided in cover 27 and in the container 13 only mutually overlap in the retracted position of the cover 27 (cf. FIG. 1), but not in the extended position of the cover (cf. FIG. 6) so that padlocks can only be hung into the securing openings 35 in the retracted position of the cover 27. It is hereby immediately visible to a user when the cover 27 is not in its retracted position and that a raising of the lockout box 11 at the carry handle 31 would then result in an opening of the lockout box 11 that is unwanted under certain circumstances.

REFERENCE NUMERAL LIST

11 lockout box
13 container
15 reception space
17 container base
19 rear side wall
21 front side wall
23 left side wall
25 right side wall
27 cover
29 hinge
31 carry handle
33 drop slot
35 securing opening
37 collar
39 closure
41 closure part
43 engagement section
45 engagement slot
47 adjustment mechanism
49 elevated portion
53 wing
55 wing
57 elongate hole arrangement
59 elongate hole
61 pin

The invention claimed is:

1. A lockout box for locking in objects, the lockout box comprising an upwardly open container for the objects; and a cover that is pivotably movably fastened to the container at one side via a joint between a closed position and an open position about a pivot axis defined by the joint, wherein the cover is provided with a carry handle for the lockout box at its upper side;

wherein a plurality of securing openings are provided in the cover and in the container for the attachment of a plurality of locking elements in order to fix the cover to the container in the closed position; and wherein a closure is provided that enables a carrying of the lockout box at the carry handle in the closed position of the cover even when locking elements are not hung in, wherein the cover is linearly displaceably attached to the joint via an adjustment mechanism between a retracted position and an extended position in a direction perpendicular to the pivot axis;

wherein the closure comprises that, at the side disposed opposite the joint, the cover has a closure part having an engagement section that engages into a closure receiver of the container in the closed position of the cover when the cover adopts the retracted position, with the engagement being released when the cover adopts the extended position, whereby a pivoting of the cover into the open position is selectively blocked or made possible; and wherein the engagement section and the closure receiver are configured such that, in the closed position, they allow a displacement of the cover from the retracted position into the extended position when the cover lies on the container and prevent a displacement of the cover from the retracted position into the extended position by means of a form fit when the cover is raised with respect to the container.

2. The lockout box in accordance with claim 1, wherein the joint comprises at least one hinge having first and second wings, with the container being fastened to the first wing and the cover being fastened to the second wing of the hinge.

3. The lockout box in accordance with claim 2, wherein the joint comprises an inner hinge having the first and second wings.

4. The lockout box in accordance with claim 2, wherein a side wall of the container is fastened to the first wing and the cover is fastened to the second wing of the hinge.

5. The lockout box in accordance with claim 2, wherein the adjustment mechanism comprises an elongate hole arrangement, with the cover being linearly displaceably fastened to the second wing (55) of the hinge via the elongate hole arrangement.

6. The lockout box in accordance with claim 5, wherein the elongate hole arrangement comprises one or more elongate holes that are formed in the second wing of the hinge, and/or that extend in parallel with one another.

7. The lockout box in accordance with claim 1, wherein the closure part is attached to an inner side of the cover.

8. The lockout box in accordance with claim 7, wherein the closure part is attached to an inner side of a collar of the cover that engages over the container in the closed position.

9. The lockout box in accordance with claim 1,
wherein the closure part is configured as a planar sheet metal part having an angled end section that forms the engagement section.

10. The lockout box in accordance with claim 9,
wherein the angled end section is horizontally oriented in the closed position of the cover.

11. The lockout box in accordance with claim 1,
wherein the closure receiver is configured as an engagement opening formed in a side wall of the container through which engagement opening the engagement section of the closure part can be led when the cover is displaced from the extended position into the retracted position.

12. The lockout box in accordance with claim 11,
wherein the engagement opening is an engagement slot.

13. The lockout box in accordance with claim 12,
wherein the engagement slot is a horizontal engagement slot.

14. The lockout box in accordance with claim 11,
wherein the form fit between the engagement section and the closure receiver is achieved in that the engagement section comprises an elevated portion that, in the retracted position of the cover, engages behind the side wall of the container at an inner side when the cover is raised with respect to the container.

15. The lockout box in accordance with claim 14,
wherein the closure part is configured as a planar sheet metal part having an angled end section that forms the engagement section, and wherein the elevated portion is produced by a sheet metal shaping process of the engagement section manufactured from sheet metal.

16. The lockout box in accordance with claim 15,
wherein provision is made that the elevated portion only extends over a part of the width of the engagement section.

17. The lockout box in accordance with claim 1,
wherein, in the closed position of the cover, the securing openings provided in the cover and in the container only mutually overlap in the retracted position of the cover.

18. The lockout box in accordance with claim 1,
wherein the cover is pivotably movably fastened to one of two lateral side walls of the container, with the lateral side walls having a smaller width than rear and front side walls of the container.

19. The lockout box in accordance with claim 18,
wherein the securing openings are only provided at the rear side wall and at the front side wall of the container and at the corresponding sides of the cover.

* * * * *